US007442256B2

(12) United States Patent
Sela et al.

(10) Patent No.: US 7,442,256 B2
(45) Date of Patent: Oct. 28, 2008

(54) APPARATUS AND METHOD FOR SPRAYING MAINTENANCE ENHANCING MATERIAL ONTO THE PERIPHERY OF A TUBULAR MEMBER

(75) Inventors: Mark Sela, Lehavim (IL); Shlomo Kline, Herzliya (IL)

(73) Assignee: Kal Sal Works Ltd., Beer-Sheva (IL)

( * ) Notice: Subject to any disclaimer, the term of this patent is extended or adjusted under 35 U.S.C. 154(b) by 131 days.

(21) Appl. No.: 10/996,656

(22) Filed: Nov. 23, 2004

(65) Prior Publication Data

US 2006/0111022 A1 May 25, 2006

(51) Int. Cl.

| | |
|---|---|
| ***B05B 13/02*** | (2006.01) |
| ***B05B 3/00*** | (2006.01) |
| ***B05B 7/06*** | (2006.01) |
| ***B08B 9/00*** | (2006.01) |
| ***B08B 3/02*** | (2006.01) |

(52) U.S. Cl. ..... 118/307; 118/323; 118/313; 118/DIG. 11; 15/104.04; 134/199

(58) Field of Classification Search ..... 118/307, 118/323, DIG. 11, 312, 313–316, 300; 134/104.2, 134/172, 122 R, 180, 199; 451/83, 89, 92, 451/38; 15/104.04; 104/89
See application file for complete search history.

(56) References Cited

U.S. PATENT DOCUMENTS

| | | | | |
|---|---|---|---|---|
| 4,989,785 | A * | 2/1991 | Walendowski | 239/227 |
| 5,199,226 | A * | 4/1993 | Rose | 451/36 |
| 5,361,791 | A * | 11/1994 | Chapman et al. | 134/122 R |
| 6,461,231 | B1 * | 10/2002 | Taylor et al. | 451/92 |

* cited by examiner

*Primary Examiner*—Yewebdar T Tadesse
(74) *Attorney, Agent, or Firm*—Alston & Bird LLP

(57) ABSTRACT

Apparatus for spraying maintenance enhancing material onto the periphery of a tubular member positioned above a ground surface, that comprises means for generating spray onto the periphery of the tubular member; means for delivering maintenance enhancing material to the spray generating means; and means for positioning the spray generating means in such a way that the periphery of the tubular member is completely impinged by the spray issuing from each spray generating means and that a line corresponding to the shortest distance of a spray issuing from the spray generating means to the periphery of the tubular member is not necessarily colinear with the radius of the tubular member.

25 Claims, 11 Drawing Sheets

APPARATUS AND METHOD FOR SPRAYING MAINTENANCE ENHANCING MATERIAL ONTO THE PERIPHERY OF A TUBULAR MEMBER

This application claims the priority of Israeli Patent Application No. 159104 , filed on Nov. 27, 2003.

FIELD OF THE INVENTION

This invention refers to an apparatus and method for carrying out the maintenance of a tubular member, particularly a tubular member located in an inaccessible area.

BACKGROUND OF THE INVENTION

Pipelines used to transport products such as fuel, gas or hazardous liquids, particularly fuel pipelines, require periodic maintenance which involves cleaning their outer surfaces and providing them with protective coating, e.g., coating for protecting the outer surfaces of the pipes from corrosion. Since these pipelines may reach thousands of kilometers in length, the maintenance is effected in stages, viz. successively on sections thereof, which have a length in the order of tens of meters. Each section is subjected to maintenance at intervals of a few years, but in view of the great length and weight of the pipelines, especially when containing liquid, the overall maintenance operations are extremely cumbersome and costly.

A great deal of damage to a pipeline is caused by external corrosion, and the maintenance procedures referred to in the present application relate to the removal of external corrosion and of a pipeline protective layer, which is well known to those skilled in the art, and the subsequent rehabilitation of the pipeline, such as by applying an anti-corrosion coating.

Prior art corrosion and protective layer removal devices generally include a spray unit, which rotates completely around the pipeline section, for sandblasting its external periphery. The spray unit comprises at least nozzle, from which sand is discharged by means of high pressure air or water. Alternatively, the spray unit may be hand held or be automatically operated by a mechanism having up to six degrees of freedom. In order to allow the spray unit to spray the entire periphery of a pipeline section, the buried section needs to be exposed and raised to a considerable height, while being securely supported. Such maintenance procedures may be carried out as fuel or gas is still within the pipeline, for more efficient delivery of the fuel or gas, thereby increasing the weight and complexity of the pipeline raising.

It is an object of the present invention to provide a method and apparatus for pipeline maintenance by which the entire periphery of a pipeline section is sprayed with suitable material.

It is an additional object of the present invention to provide a method and apparatus for pipeline maintenance which reduces, with respect to the prior art, the height to which a pipeline section needs to be raised, thereby reducing the risk for mechanical failure.

It is an additional object of the present invention to provide an apparatus for pipeline maintenance that is axially displaceable along the length of the pipeline.

It is yet an additional object of the present invention to provide a method and apparatus for pipeline maintenance which is cost effective.

Other objects and advantages of the invention will become apparent as the description proceeds.

SUMMARY OF THE INVENTION

The present invention provides an apparatus for spraying maintenance enhancing material onto the periphery of a tubular member positioned above a ground surface, comprising:

a) means for generating spray onto the periphery of the tubular member;

b) means for delivering maintenance enhancing material to said spray generating means; and c) means for positioning said spray generating means in such a way that— i. the periphery of said tubular member is completely impinged by the spray issuing from each spray generating means; and ii. that a line corresponding to the shortest distance of a spray issuing from said spray generating means to the periphery of said tubular member is not necessarily colinear with the radius of said tubular member.

The apparatus is suitable for the removal of corrosion and of a protective layer, as well as for the application of paint. The tubular member is preferably a section of a fluid pipeline, maintenance enhancing material being sprayed onto the periphery of the pipeline section when fluid is still within said section.

The spray generating means that is adapted to spray the lowest point of a horizontally disposed tubular member is positioned such that the angle between a line corresponding to the shortest distance of a spray issuing from said spray generating means to the periphery of the tubular member and the vertical centerline of the tubular member is greater than 20 degrees.

In one embodiment of the invention, the spray generating means are a plurality of fixed nozzles, the sprayed material being entrained by a fluid, such as a gas, under sufficient pressure to allow a spray of said material to impinge the periphery of the tubular member.

In a second embodiment of the invention, the spray generating means are a plurality of driven rollers, to each of which a sprayed material is delivered, said solution being dispersed in form of a spray by means of the rotation of each driven roller. The circumferential distance of impingement along the periphery of the tubular member is controllable.

In a third embodiment of the invention, the spray generating means is at least one displaceable nozzle along and/or around the pipeline.

In one aspect, each displaceable nozzle is rotatable about an axis substantially perpendicular to the axis of the tubular member, an elongated path of impingement being generated along the periphery of the tubular member upon rotation of each displaceable nozzle. The spray angle of each displaceable nozzle is adjustable, the spray angle preferably being constant during generation of an elongated path of impingement. The spray angle is adjustable by means of a mechanism selected from the group of gimbal joint, at least one shaft, and a ball-and-socket joint.

In another aspect, the displaceable nozzle is carried by at least one member rotatable about the axis of the tubular member, the nozzle being affixed to a conduit rotatably mounted within a sheathing which is connected to said at least one rotatable member, said conduit being rotated in such a way that the nozzle continuously faces the periphery of the tubular member.

Preferably, arcuate rotatable members are supported and radially restrained by a plurality of guide rollers rotatably mounted on arcuate stabilizer members, said stabilizer members being rigidly connected to the frame of the apparatus.

The rotatable members, upon application of a torque thereto, are rotatable relative to the stabilizer members, following immobilization of the frame.

The angular displacement of the rotatable members is preferably limited by abutment plates affixed at the two circumferential ends, respectively, of a rotatable member, said abutment plate adapted to contact the frame of the apparatus when the rotatable members are rotated beyond a predetermined rotational limit.

Torque is preferably transmitted to the rotatable members by means of a plurality of driven sprockets mounted on the outer side of each stabilizer member, said plurality of driven sprockets being engageable with a toothed transmission device mounted between two plates from which a rotable member is formed. The engagement of said driven sprockets with said toothed transmission device prevents the reverse rotation of the rotatable members upon cessation of the torque.

In a fourth embodiment of the invention, the spray generating means comprise a casing and an impeller rotatable within said casing, said casing formed with a plurality of closed portions and open portions, the maintenance enhancing material being admitted to the interior of said casing and radially exiting said casing through said open portions. Preferably, each of said closed portions longitudinally extends throughout the entire length of said casing Preferably, the apparatus is longitudinally displaceable. The apparatus is longitudinally displaceable by means of at least one concave roller having a variable cross-section with a sufficiently equal curvature to that of the tubular member, so that a roller placed on top of the tubular member is in frictional engagement with the periphery thereof, each of said concave rollers being rotatingly mounted in a corresponding hanger affixed to the frame of the apparatus, rotation of one of said concave rollers thereby inducing longitudinal displacement of the apparatus.

The maintenance enhancing material is selected from the group of paint, granular abrasive material and high-pressure fluid. The granular abrasive material may be sand, metallic granules or polymeric granules.

In one aspect, the apparatus further comprises an enclosure placed around the tubular member, which allows for the collection of and recycling of spent granular abrasive material. The enclosure is preferably longitudinally displaceable by means of the at least one concave roller having a variable cross-section.

The granular abrasive material is recycled by vacuum generating means for drawing spent granular abrasive material and debris detached from the tubular member to at least one filter, and by a particulate separator for separating purified abrasive granules from other debris, recycled granular abrasive material thereby being collected into a suitable vessel. The recycled granular abrasive material is entrainable by a fluid which is deliverable to the spray generating means.

The vacuum generating means, at least one filter and means for generating the fluid for entraining the recycled granular abrasive material are preferably stationary.

The present invention is also directed to a method for automated spraying of maintenance enhancing material onto the periphery of a tubular member positioned above a ground surface, comprising:

a) providing at least one displaceable nozzle;

b) positioning each displaceable nozzle in such a way that a line corresponding to the shortest distance of a spray issuing from each displaceable nozzle to the periphery of said tubular member is not necessarily colinear with the radius of said tubular member;

c) delivering maintenance enhancing material to each of said displaceable nozzle, whereby to generate an elongated impingement path on the periphery of the tubular member; and d) automatically displacing each nozzle to a plurality of positions and repeating step c) for each position until the periphery of said tubular member is completely impinged by the plurality of impingement paths, wherein the angle between a line corresponding to the shortest distance of a spray issuing from each nozzle to the periphery of the tubular member and the vertical centerline of the tubular member is greater than 20 degrees.

DETAILED DESCRIPTION OF PREFERRED EMBODIMENTS

The present invention relates to a method and apparatus for spraying maintenance enhancing material, such as paint or a granular abrasive material, which is entrained by a stream of fluid such as air or water, onto a pipeline periphery, in order to facilitate maintenance of the pipeline, such as for corrosion removal or application of paint. The maintenance enhancing material is sprayed obliquely onto the underside of the pipeline, and therefore the entire periphery of a pipeline section may be sprayed without a spray nozzle having to be positioned underneath said pipeline section. Whereas a pipeline section needs to be raised approximately 1.5 m so that prior art pipeline maintenance equipment can effectively spray the entire periphery of the pipeline, the apparatus of the present invention requires the pipeline to be raised only 40-60 cm, thereby reducing the complexity of, and the time associated with, the pipeline raising.

Figure 1:
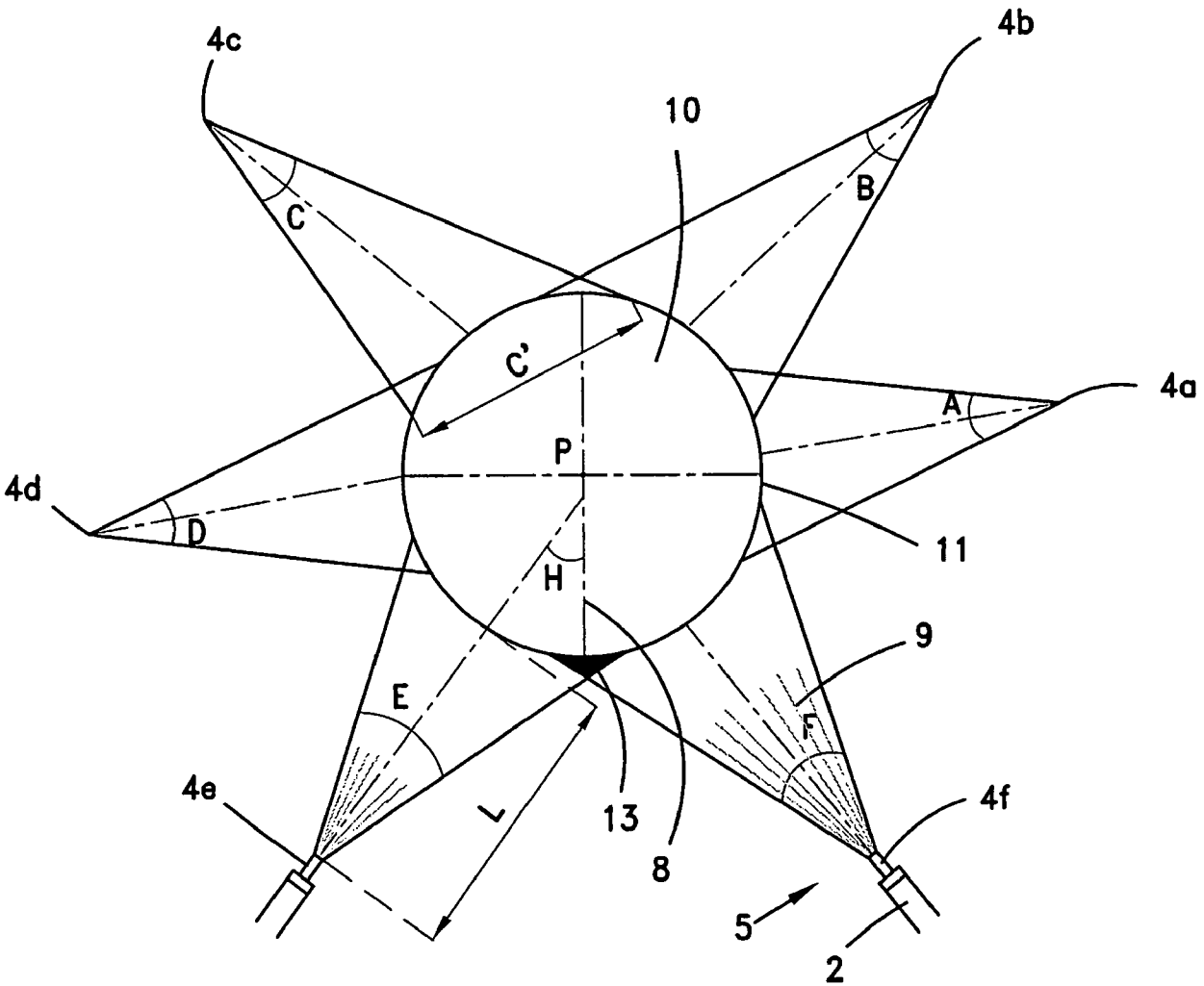
FIG. 1 is a schematic drawing, showing the positioning of stationary nozzles, according to one embodiment of the invention.

One embodiment of the present invention, which comprises a spraying apparatus generally indicated by numeral 5, is illustrated in FIG. 1. After pipeline section 10 of approximately 30 m is unearthed and securely supported, said pipeline section is raised 40-60 cm, so that the underside thereof may be impinged by a spray 9, and maintenance of the entire pipeline periphery may therefore be effected.

Spraying apparatus 5 comprises stationary nozzles 4*a-f*, each of which is positioned by means well known to those skilled in the art, at a different angular disposition with respect to center P of pipeline section 10. The maintenance enhancing material is fed to each nozzle 4 through a corresponding conduit 2, e.g. a flexible tube, and is propelled by a fluid under sufficient pressure, such as water or air, so that the material may impinge periphery 11.

The configuration and disposition of each nozzle 4, as well as the shortest radial distance L from a nozzle to periphery 11, are selected in order to ensure that periphery 11 is completely sprayed, with an optimal utilization of the material.

Due to the unique configuration and disposition of each nozzle, a different spray angle, e.g. spray angles A-F, as illustrated, may be generated from each nozzle. The circumferential distance of maintenance enhancing material impingement on periphery 11 is also different for each nozzle, depending on the radial distance L from the nozzle to the pipeline periphery, e.g. circumferential distance C' for spray angle C. An optimal utilization of sprayed maintenance enhancing material is realized by reducing the overlapping of adjacent spray angles. For example, spray angles E and F overlap at sector 13, and this overlapping ensures that the underside of pipeline section 10 will be completely sprayed by the maintenance enhancing material.

It will be appreciated that the reduced distance to which pipeline section 10 needs to be raised, relative to a prior art pipeline maintenance apparatus, is advantageously achieved as a result of the angular disposition of nozzles 4*e* and 4*f*, which spray the underside of the pipeline section. In contrast to prior art spray devices which rotate about a pipeline section, such that the axis of rotation coincides with center P of the pipeline, necessitating sufficient clearance under the pipeline section for the rotation of the spray device around the pipeline section, nozzles 4*e* and 4*f* are laterally spaced from the vertical centerline 8 of the pipeline section. Consequently, the spray issuing from nozzles 4*e* and 4*f* obliquely impinge periphery 11, i.e. the angle H between shortest radial distance L and vertical centerline 8 is greater than 20 degrees. Therefore pipeline section 10 can be raised a shorter distance than with the use of prior art maintenance devices, since the nozzles that spray the underside of the pipeline section are laterally spaced from the vertical centerline of the pipeline section.

Another embodiment of the present invention, which comprises a spraying apparatus generally indicated by numeral 25, is illustrated in FIGS. 2 and 3. The maintenance enhancing material is propelled to pipeline section 10 by means of a driven roller 30, on which a solution of the maintenance enhancing material is dripped.

Figure 2A:
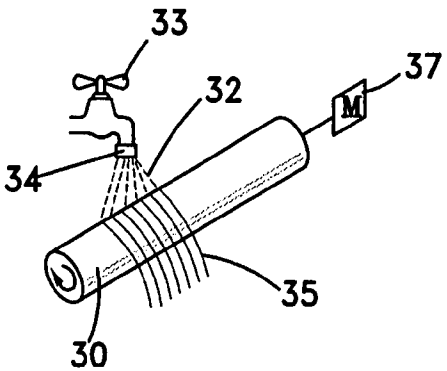
FIGS. 2A-D are schematic drawings, showing the positioning of driven rollers, according to another embodiment of the invention.

As shown in FIG. 2A, a low pressure solution 32 of maintenance enhancing material is delivered by valve 33, e.g. a household faucet, onto solid roller 30. Depending on the opening of valve 33, solution 32 may be dripped, or delivered in a fast flowing stream, onto the roller. Nozzle 34 with a predetermined spray pattern is preferably attached to the outlet of valve 33, so that solution 32 will be delivered across substantially the entire length of roller 30. Roller 30 is driven by motor 37, and therefore solution 32 is dispersed by the changing velocity distribution of the air stream generated by the rotating roller, forming a spray. A spray 35 propelled by the driven roller is directed towards the pipeline section.

Figure 2B:
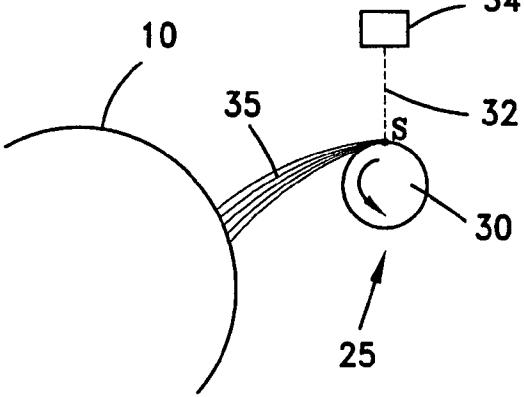
Figure 2C:
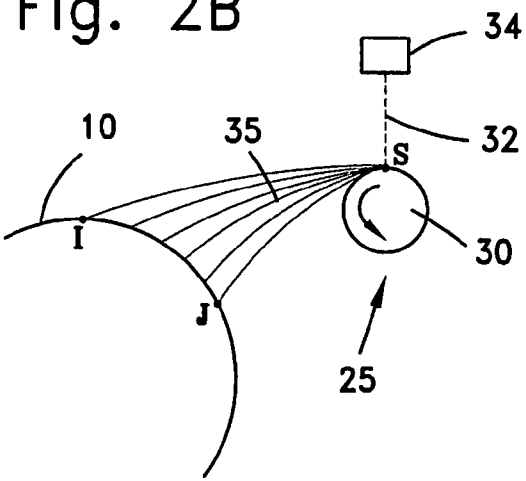

When roller 30 is driven at a relatively low rotational speed, as shown in FIG. 2B, propelled spray 35 originally streams tangentially from roller 30 at contact point S of solution 32 with the roller and then descends by a curved flow onto pipeline section 10, due to the decreased influence of centrifugal force. Upon increasing the rotational speed of roller 30, propelled spray 35 streams tangentially from contact point S of the roller to impingement point I on the pipeline section, as shown in FIG. 2C, due to the increased influence of the centrifugal force applied by the rotating roller. Some of solution 32 adheres to roller 30 for a fraction of a rotation until being detached from the roller at point T, whereupon propelled spray 35 streams tangentially from detachment point T until impinging the pipeline section 10 at point J. Whereas the spray angle V of propelled spray 35 issuing from roller 30, which is defined as that angle subtended by a vertical projection of the propelled solution generated by the spray means relative to a laterally extending horizontal line, is substantially equal to that of FIG. 2B, the circumferential distance of impingement, i.e. between points I and J, is considerably greater than that of FIG. 2B, due to the influence of the increased centrifugal force.

Figure 2D:
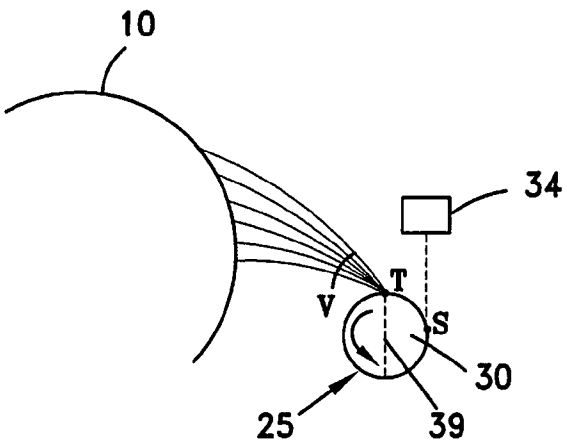

The spray pattern may be changed by adjusting contact point S of solution 32 with the roller. In FIG. 2D, contact point S, which does not coincide with the vertical centerline 39, as in FIG. 2C, is diametrically opposite to the point of the roller that is closest to the pipeline section. Although the spray angle may also be V, the spray pattern is different than that illustrated in FIG. 2C. Whereas the propelled spray of FIG. 2C is horizontal at contact point S and then is inclined at point T, the propelled spray of FIG. 2D is inclined at contact point S and then is horizontal at detachment point T.

Figure 3A:
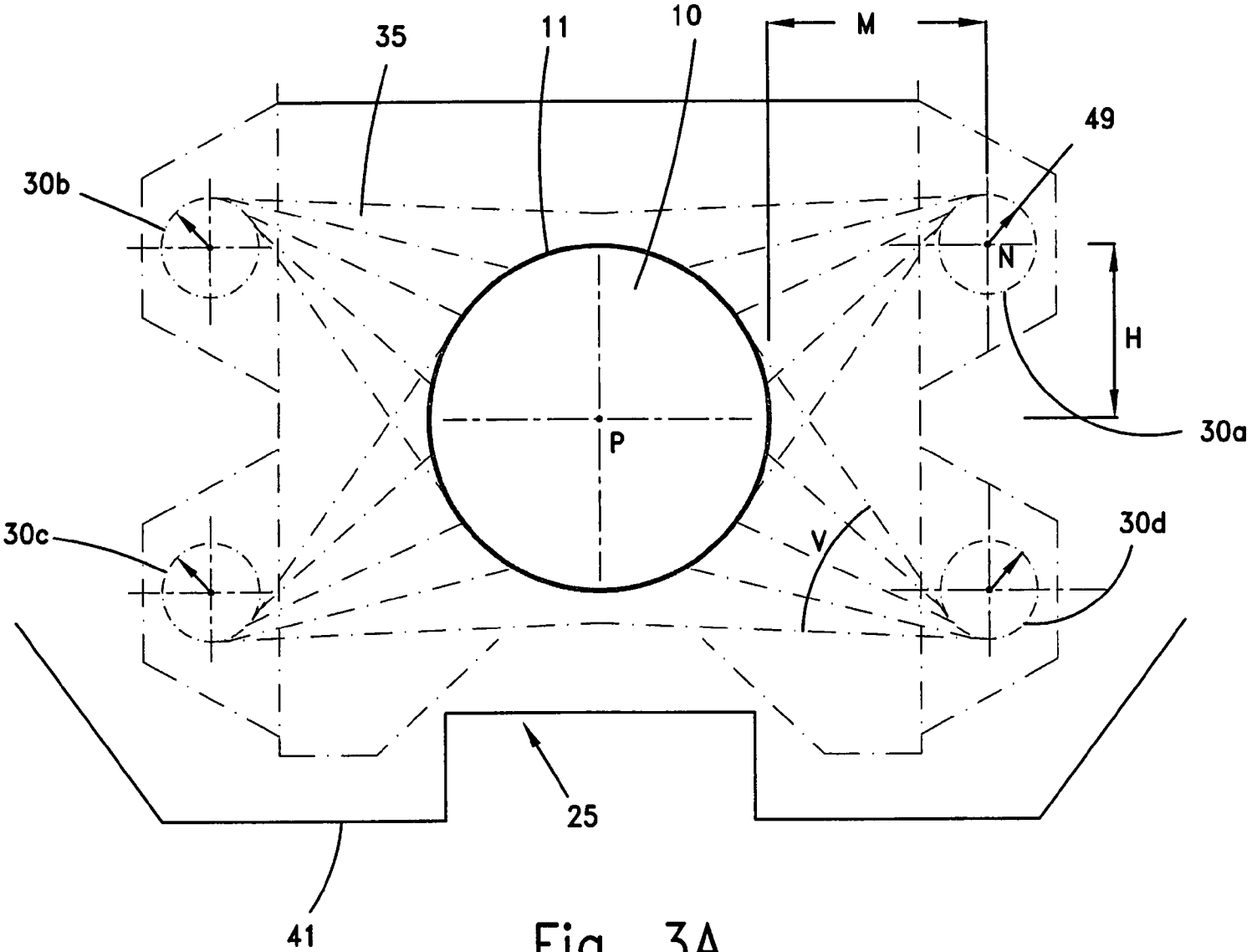
FIG. 3A is a schematic drawing of a front view of the apparatus according to the embodiment of FIG. 2, showing the spray angle of a plurality of rollers.
Figure 3C:
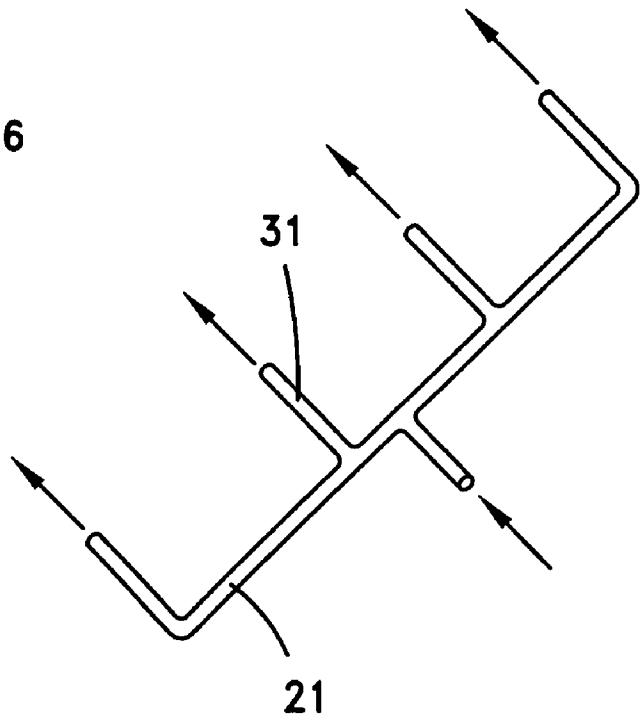
FIG. 3C is a schematic drawing of a manifold for feeding an impeller.

A typical arrangement of the rollers relative to a pipeline section is illustrated in FIG. 3A. Spraying apparatus 25 comprises enclosure 41 and four rollers 30*a-d*, two of which are positioned on each lateral side of pipeline section 10. After pipeline section 10 of approximately 30 m is unearthed and securely supported, said pipeline section is raised 40-60 cm within enclosure 41. Enclosure 41 is transportable along the length of the pipeline, and is of any suitable shape, so as to receive therein the pipeline section 10 and the plurality of rollers 30*a-d*.

Due to the configuration and position of each roller relative to the longitudinal axis P of pipeline section 10, maintenance enhancing material may be sprayed around the entire periphery 11 of the pipeline section. Each roller 30 is rotatingly supported by a corresponding support 49, so that the roller is laterally separated from periphery 11 by a distance of M. Also, each roller 30 is positioned so that its axis N is vertically separated from axis P of the pipeline section by a distance of H, with axis N of rollers 30*a* and 30*b* being above axis P of pipeline section 10 and the axis of rollers 30*c* and 30*d* being below the axis of the pipeline section. The conduit (not shown), valve and nozzle through which a solution of maintenance enhancing material is delivered onto a corresponding roller are retained by the corresponding support 49. The rollers are accordingly configured to produce a spray pattern of V degrees, wherein the propelled spray 35 tangentially streaming from the corresponding roller 30 is proximate to, but does not impinge, periphery 11 of the pipeline section, and a portion of propelled spray 35 obliquely impinges periphery 11.

Each roller is adapted for impinging slightly more than 90 degrees of periphery 11 by the spray issued therefrom.

The circumferential distance of impingement is dependent upon several parameters: number of rollers 30, diameter of pipeline section 10, diameter of each roller 30, distance M between the axis of a roller and periphery 11, height H between the axis of a roller and the axis of the pipeline section, the spray angle V, the spray pattern, the rotational speed of the rollers, and the density of the maintenance enhancing material that is propelled by the rollers. Thus the circumferential distance of impingement can be controlled, in order to minimize the amount of adjacent propelled spray overlapping, by varying one or more of the aforementioned parameters as a result of design constraints.

The arrangement illustrated in FIG. 3A is also suitable for propelling maintenance enhancing material by means of stationary tubular casing members, in each of which an impeller rotates. For purposes of clarity, the placement of each casing may be identical to the illustrated rollers, whereby to produce a similar spray pattern.

Figure 3B:
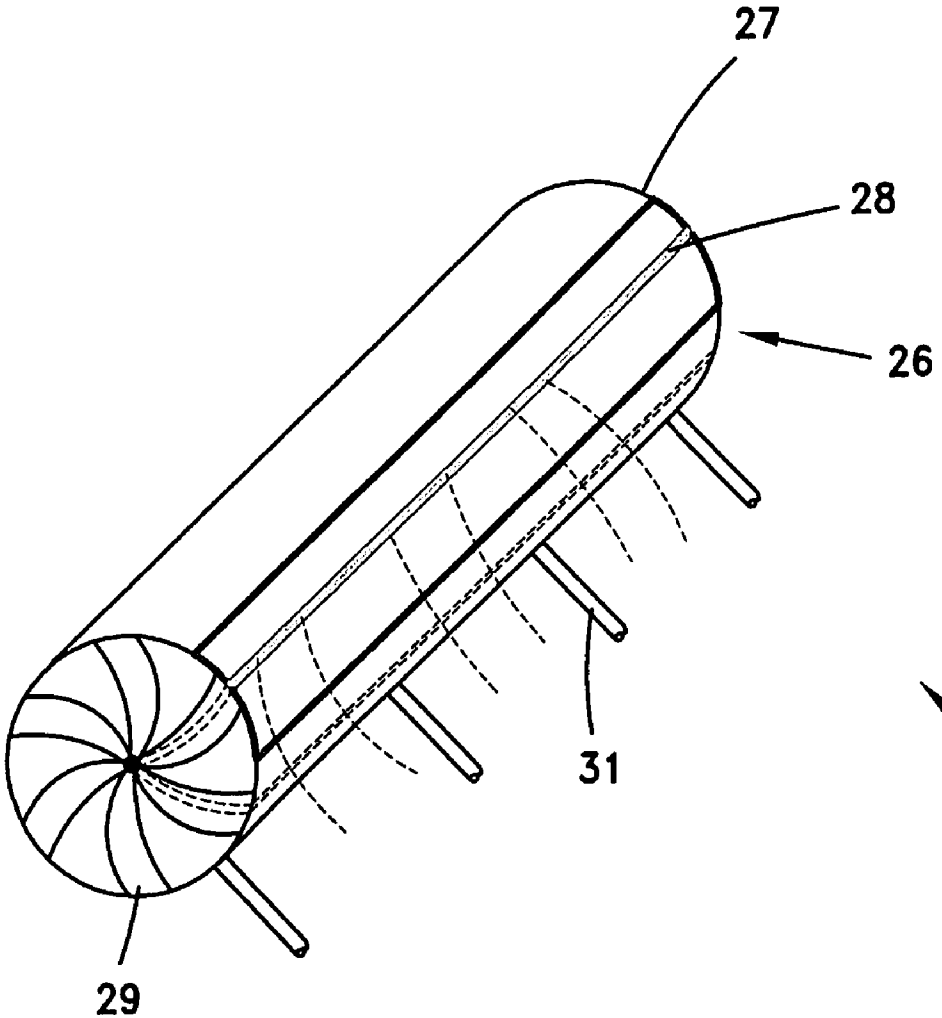
FIG. 3B is a perspective view of a casing, which is suitable for generating a spray with the apparatus of FIG. 3A.

As shown in FIG. 3B, each casing, which is generally indicated by numeral 26, is formed with a plurality of closed portions 27 and open portions 28. Each peripheral closed portion 27 longitudinally extends throughout the entire length of the casing, and each open portion 28 is similarly formed throughout the entire length of the casing. The width of each open portion 28 is selected in such a way, so as to generate a predetermined spray pattern. The axis of rotation of impeller 29 coincides with the longitudinal axis of casing 26. As maintenance enhancing material is admitted to casing 26 by a plurality of inlet ports 31, which are in communication with the interior of the casing at predetermined locations, e.g. along the underside of the casing or by a manifold 21 (shown in FIG. 3C), the rotation of impeller 29 imparts a rotating motion to the maintenance enhancing material. The maintenance enhancing material radially exits the casing via open portions 28 and accordingly impinges the pipeline section.

When the maintenance enhancing material is sand or another type of granular abrasive material, pipeline section 10 may be sandblasted, in order to remove corrosion formed on the periphery thereof. A prior art sandblasting apparatus is generally characterized by an inordinate waste of material. By employing enclosure 41, granular abrasive material, particularly metallic or polymeric granules, may be recaptured and recycled, thereby adding to the cost savings that can be realized by sandblasting with the use of the present invention.

Figure 4:
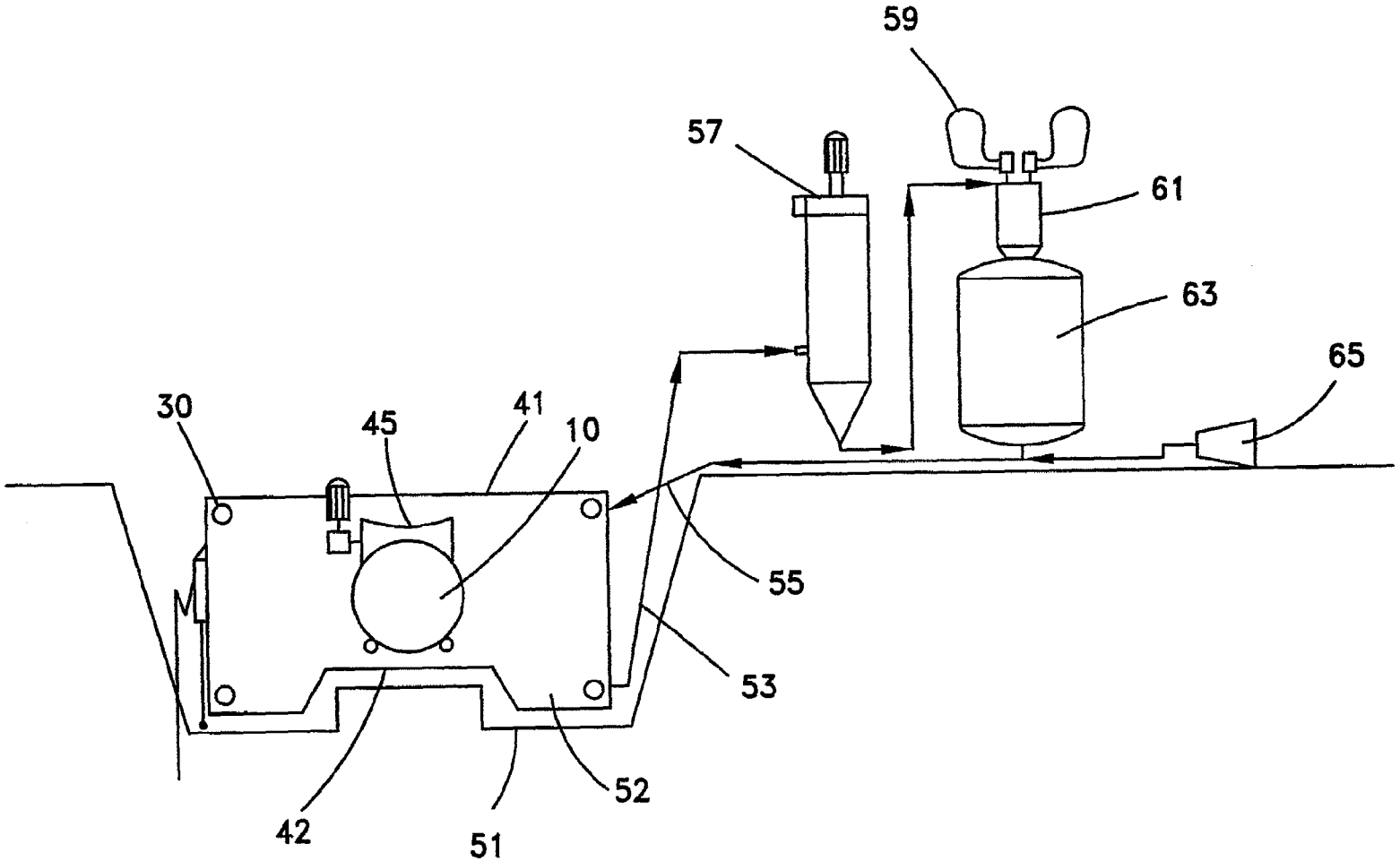
FIG. 4 is a schematic drawing of apparatus for recycling maintenance enhancing material according to the embodiment of FIG. 2.

FIG. 4 illustrates a schematic diagram of an exemplary apparatus for delivering and recycling granular abrasive material. Pipeline section 10 is shown to be raised above trench 51 with a sufficiently small clearance that allows for the impingement of its periphery, e.g. by sandblasting, in accordance with the present invention. Bottom 42 of enclosure 41 is placed between pipeline section 10 and trench 51, while enclosure 41 is shaped such that it collects the granules.

Enclosure 41, to which rollers 30 for spraying pipeline section 10 with maintenance enhancing material are supported, is longitudinally conveyed along the pipeline, in order to allow maintenance to be carried out on other pipeline sections. The drive means 45 for the enclosure, and consequently for the rollers, is rollingly supported by pipeline section 10, so that the enclosure may be easily and speedily conveyed to another pipeline section, upon command by an operator. Each conduit 55, through which maintenance enhancing material is delivered to rollers 30, is flexible, e.g. a rubber hose, in order to allow for longitudinal displacement of the enclosure and of the rollers.

Upon completion of a cycle during which abrasive granules are sprayed onto pipeline section 10, as described hereinabove, the spent granules and debris, such as dirt, corrosion flakes and paint flakes, which were detached from the pipeline section during the sandblasting cycle, fall onto enclosure bottom 42 and are gathered into area 52. Suction pump 57, or any other means to generate a vacuum, entrains the spent granules and fallen debris in a gas stream flowing through flexible suction line 53. Discharge from suction pump 57 is directed to filters 59, which filter contaminants from the flowing gas stream, and then to centrifugal particulate separator 61, whereupon purified abrasive granules fall into recovery vessel 63. In order to replenish the supply of granules, new granules may be fed into vessel 63. During commencement of a spray cycle, pump 65 delivers water or air under pressure, into which purified granules are released and entrained, through conduit 55. The solution of maintenance enhancing material is delivered to each valve 33 (FIG. 2), for subsequent introduction to each roller 30, as described hereinabove. Suction pump 57, particulate separator 61, and pump 65 are stationary, remaining outside of trench 51, during displacement of enclosure 41.

Figure 5:
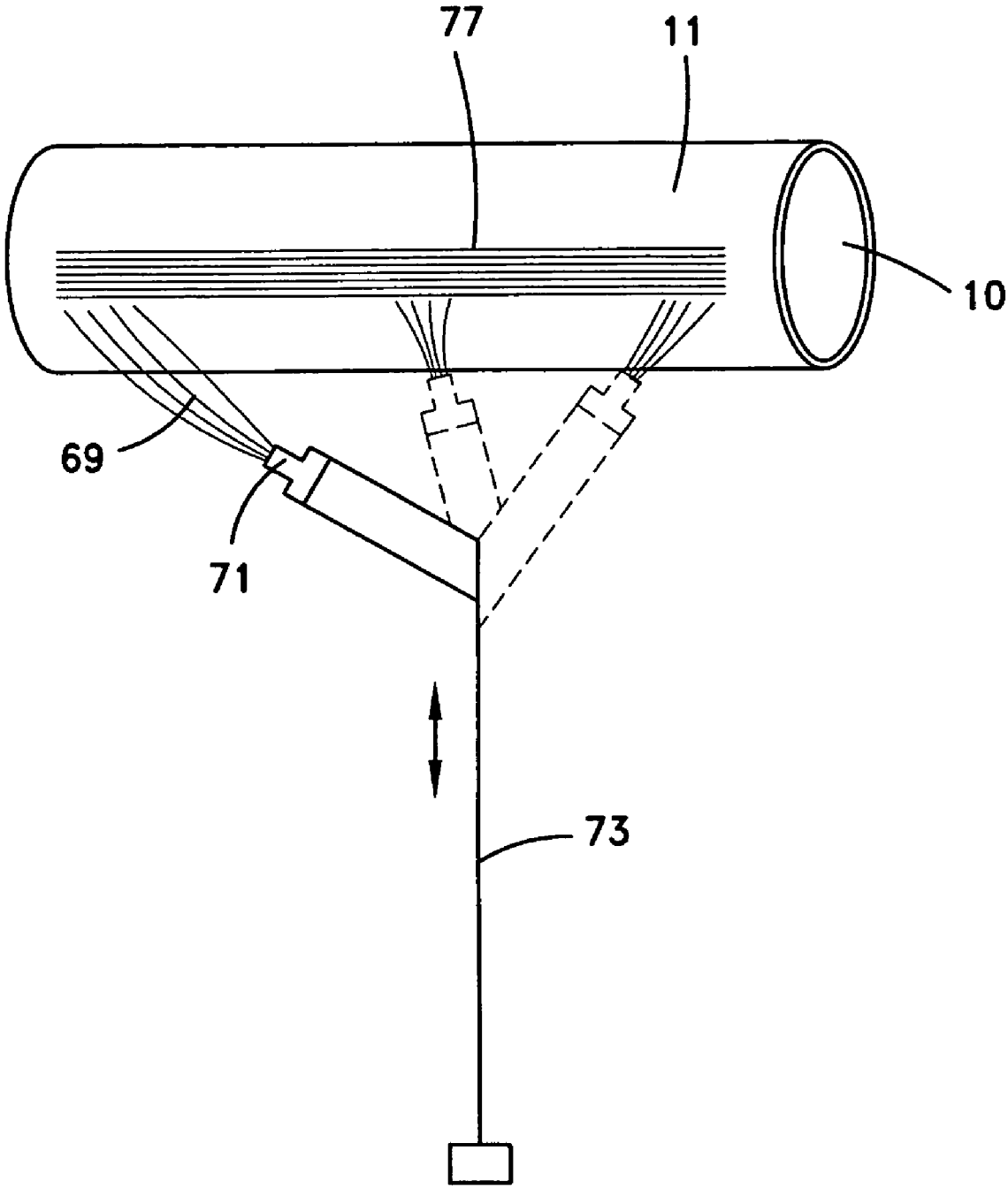
FIG. 5 is a schematic drawing of the generation of an impingement path with the use of a displaceable nozzle.

FIG. 5 schematically illustrates another embodiment of the invention, for automated oblique spraying of the periphery of pipeline section 10, so that material may be more efficiently utilized. Nozzle 71 issuing spray 69 of maintenance enhancing material is rotated about vertical axis 73 by displacing means 74, which generally is at least one electric motor, such that the spray impinges periphery 11 in an essentially horizontal path 77. The length of path 77 that can be impinged by the nozzle is dependent on the total angular displacement provided by displacing means. In order to ensure an essentially horizontal path of impingement, the mechanism that imparts motion to nozzle 71 is structured such that the spray angle of nozzle 71 remains constant during rotation, from one end of a path to the other end. The circumferential distance of impingement is a function of the distance of vertical axis 73 of rotation from the longitudinal axis of pipeline section 10 and of the spray pattern of nozzle 71. Upon completion of a horizontal path, displacement means 74 displaces nozzle 71 such that the subsequent path of impingement is adjacent to the previous path of impingement, thereby ensuring continuous impingement of maintenance enhancing material throughout periphery 11. The number of displaceable nozzles that are needed to ensure continuous impingement throughout the periphery without having to be rotated underneath the pipeline section is dependent on the selected spray angle, the circumferential distance of impingement, the pressure of the fluid that propels the maintenance enhancing material to periphery 11, and the maximum difference in height to which a nozzle may be displaced. A controller (not shown) may control the operation of displacing means 74.

Figure 6:
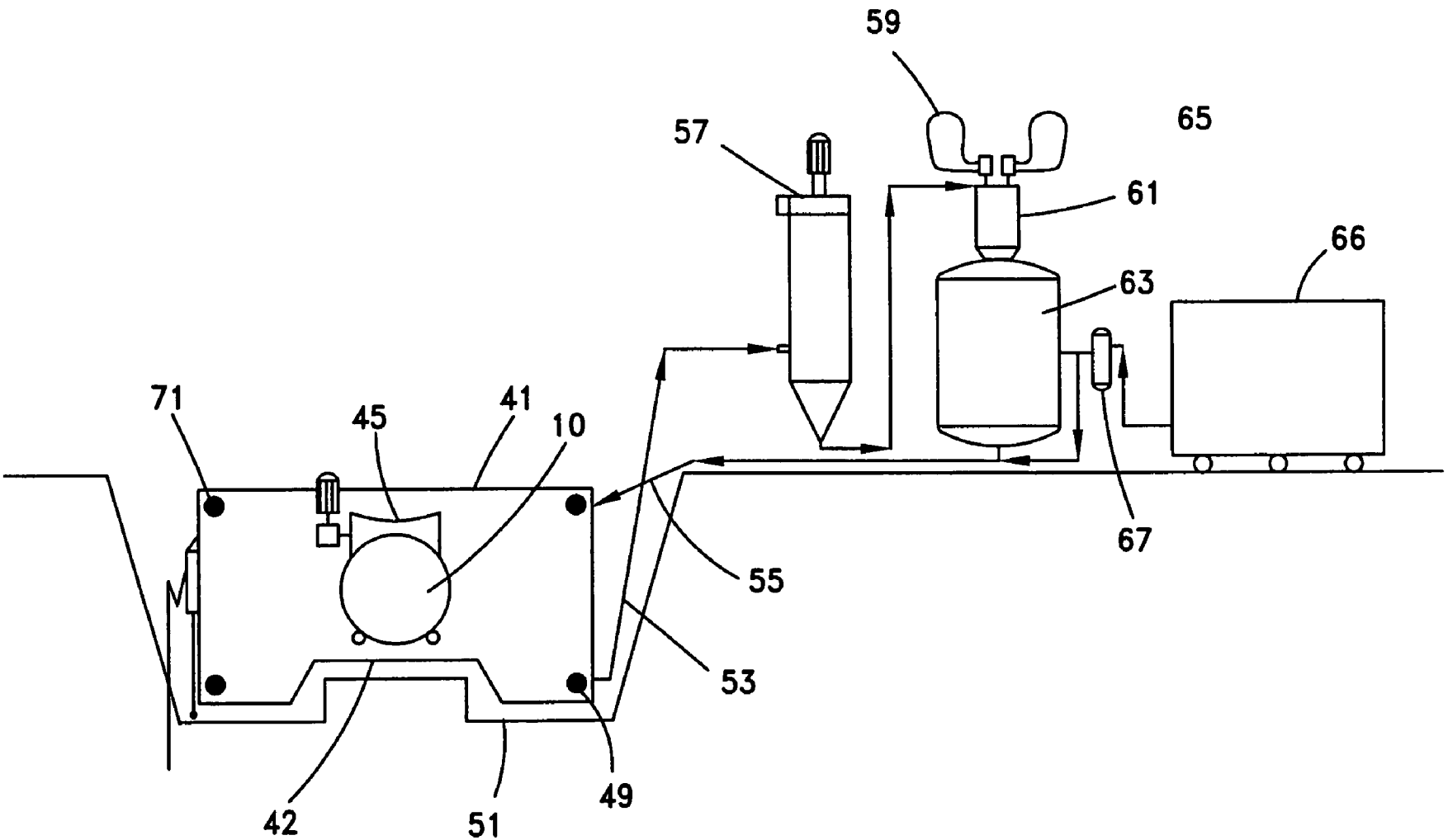
FIG. 6 is a schematic drawing of apparatus for recycling maintenance enhancing material according to the embodiment of FIG. 5.

By employing a displaceable nozzle 71 for providing oblique spraying of pipeline section 10, compressed air may be the medium for propelling the spray. As shown in FIG. 6, upon commencement of a sandblasting cycle, clean, compressed air is forced from compressor 66 and then to dehumidifier 67. Dehumidified compressed air flows through conduit 55, into which purified granules are released from vessel 63 and entrained by the compressed air, and then the entrained granules are delivered to nozzles 71. The recycling of granules is similar to the aforementioned description in relation to FIG. 4.

Figure 7B:
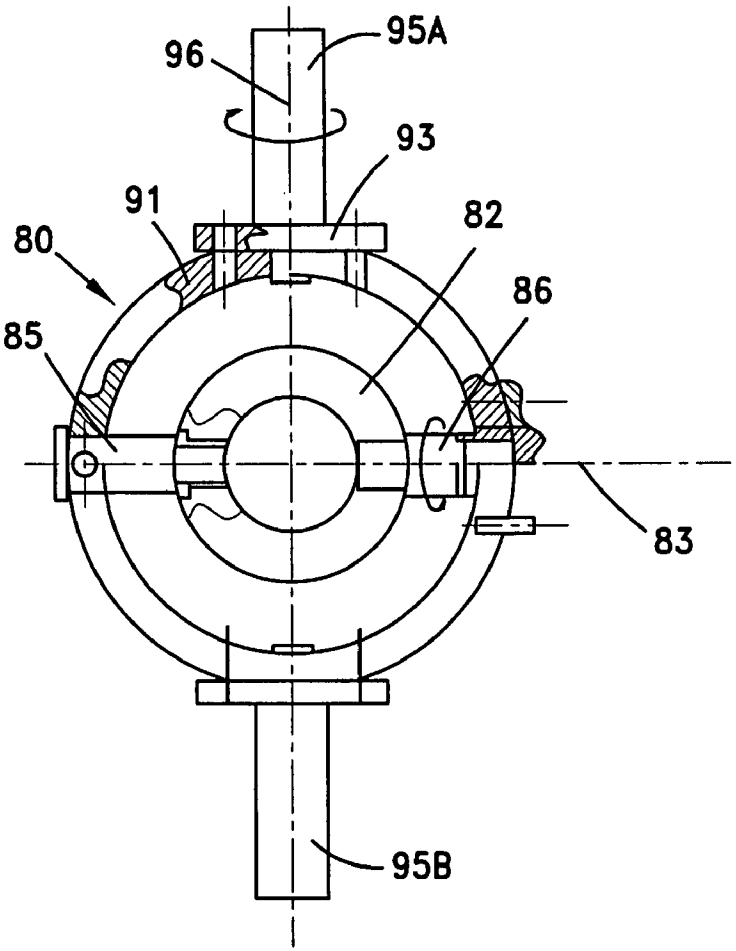
FIGS. 7A and 7B are side and front views, respectively, of one mechanism used for positioning a displaceable nozzle.
Figure 7A:
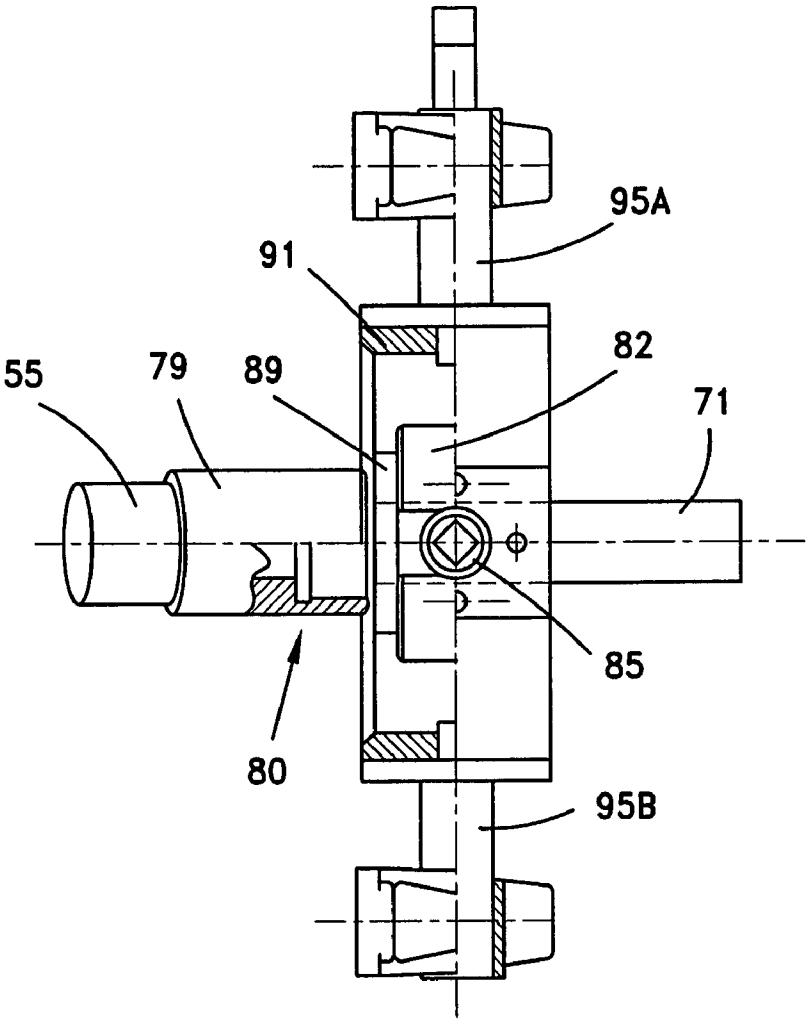

FIGS. 7A and 7B illustrate an exemplary mechanism which allows the spray angle of a nozzle to remain constant during rotation, from one end of an impingement path to the other end. The illustrated mechanism utilizes gimbal joint 80, which allows gimbal 91, and consequently nozzle 71, to be rotated about two mutually perpendicular axes. Maintenance enhancing material is delivered through conduit 55, adapter 79 and nozzle 71, from which it is sprayed onto the periphery of a pipeline section. Nozzle 71 is keyed, or is rigidly affixed by any other suitable means, to rotor 82. Rotor 82 in turn is keyed to diametrically opposite rods 85 and 86 with a common axis 83, which are coupled to the rotor and to corresponding shafts, one of which is driven by displacing means 74 (FIG. 5). Annular ring 89 connects rotor 82 to gimbal 91, and consequently rotor 82 and gimbal 91 are displaceable in unison.

The top and bottom of gimbal 91 is fastened to a corresponding flange 93, each of which is keyed to substantially vertical shafts 95A and 95B, respectively, having a common axis 96, which is perpendicular to axis 83. The axis of gimbal 91 is coincident with the intersection of axes 83 and 96. As a spray is being issued from nozzle 71 during the course of an impingement path, a substantially vertical shaft 95 is rotated by displacing means 74, causing gimbal 91, rotor 82 and nozzle 71 to be rotated a predetermined angular displacement about axis 96 which generates an impingement path having a desired length. During rotation about axis 96, rods 85 and 86 are locked, preferably by a controller. Upon completion of an impingement path, shafts 95A and 95B are locked and rods 85 and 86 are unlocked. Another spray angle may be selected by rotating rotor about axis 83, at a sufficient angular displacement that can generate another impingement path that is adjacent to, but does not overlap to a large extent, the previously generated impingement path.

Figure 8:
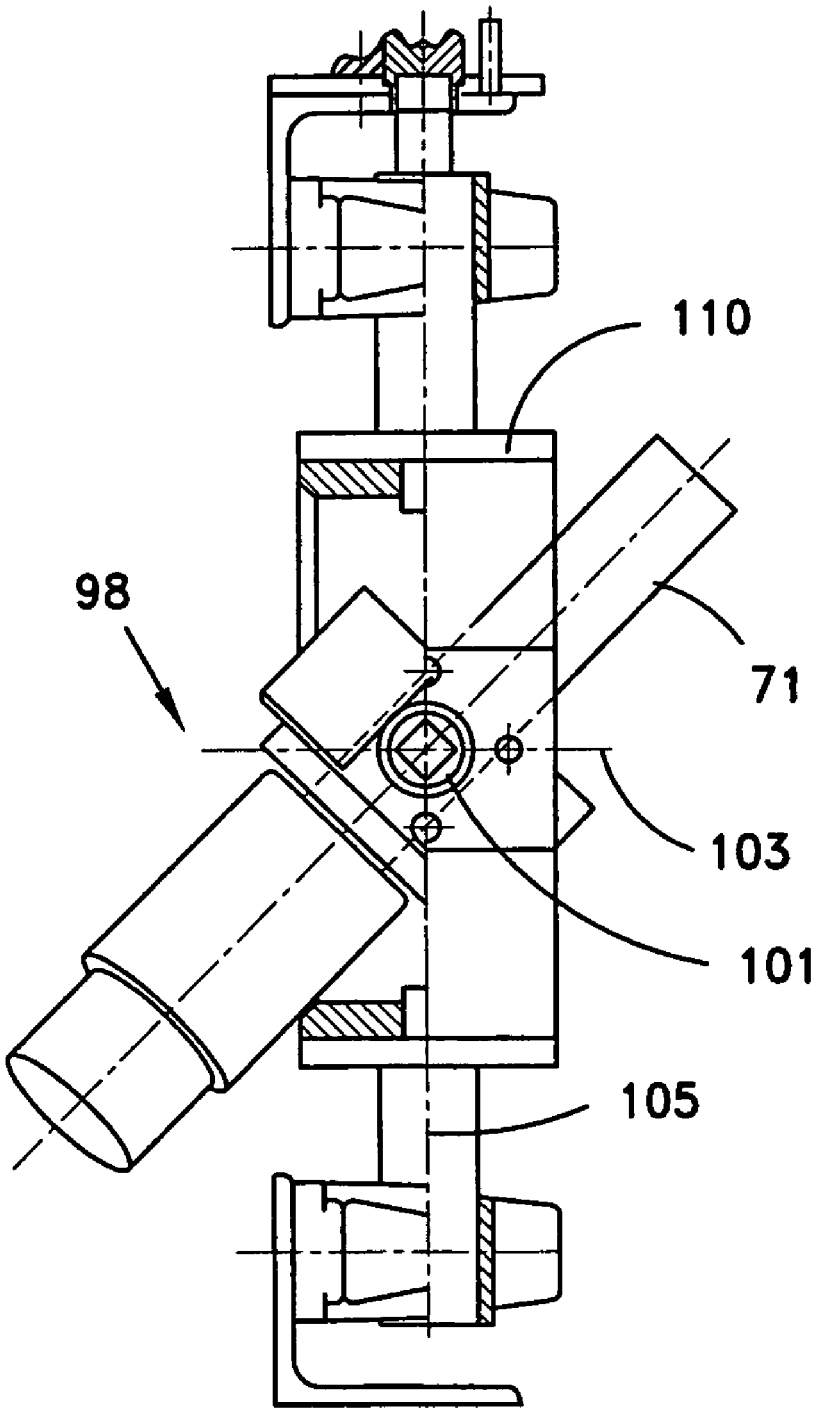
FIG. 8 is a side view of another mechanism used for positioning a displaceable nozzle.

FIG. 8 illustrates another exemplary mechanism which allows the spray angle of a nozzle during generation of an impingement path. Nozzle 71 is pivotable about a shaft, or a pair of shafts, having an axis that is perpendicular to vertical axis 105, about which assembly 110 housing the nozzle, rotates. Nozzle 71 may be secured to assembly 110, to ensure that the spray angle will be constant during the rotation of assembly about axis 105.

Similarly, the nozzle may be displaceable by means of a ball-and-socket joint, or by any other suitable mechanism.

The aforementioned apparatus is suitable for the maintenance of any tubular member, for various other applications such as the cleaning of pipes at a power plant or of transcontinental cables buried underwater. It will be appreciated that the spray angle during generation of an impingement path may be variable, if so desired. Similarly, the tubular member may not necessarily be horizontal during maintenance and the axis about which the nozzle housing rotates may be inclined.

EXAMPLE 1

Corrosion Removal

Figure 9:
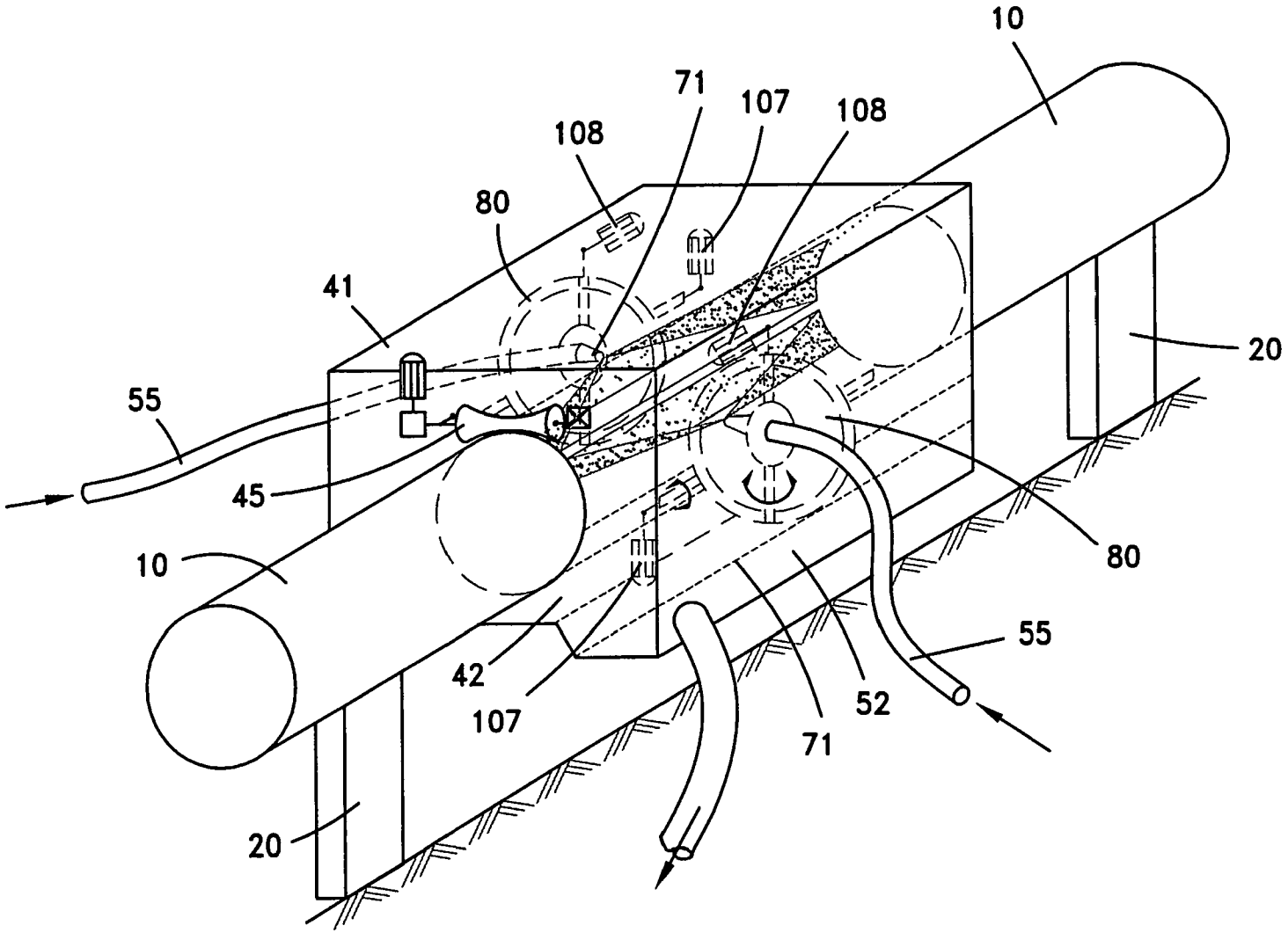
FIG. 9 is a perspective view of apparatus used for corrosion removal, in accordance with the present invention.

FIG. 9 illustrates an apparatus that was used to remove corrosion from the outer surface of a buried pipeline having an inner diameter of 107 cm, when oil was flowing therethrough.

A trench having a width of 3 m was dug, and a pipeline section 10 of 1000 m was raised a height of 50 cm. The pipeline section was supported by two supports 20, spaced 30 m from each other. Pipeline section 10 passed through opposite walls of enclosure 41.

Metallic granules, which were delivered through flexible conduit 55 to two displaceable nozzles 71, were entrained by compressed air. Each nozzle 71 was disposed at a different lateral side of pipeline section 10. A gimbal joint 80 mounted on a wall of enclosure 41 was used to allow each nozzle 71 to be rotated about two mutually perpendicular axes, as indicated by the arrows. Motor 107 drove a substantially vertical shaft, so that nozzle 71, which was directed at the periphery of pipeline section 10, generated an essentially horizontal path of impingement, and corrosion was removed from the periphery at a rate of 0.4 m per minute. After completing a first impingement path, motor 108 rotated gimbal joint 80, in order to generate a second impingement path. A plurality of impingement paths were generated by each nozzle, in order remove corrosion from the entire periphery of the pipeline section. The operation of motors 107 and 108 was synchronized by a suitable controller.

Spent granules fell onto enclosure bottom 42 and were gathered into area 52. A suction pump generated a vacuum, urging the spent granules and fallen debris through flexible suction line 53. The spent granules were recycled, and were reused for 100 sandblasting cycles.

After corrosion was removed from the entire periphery of pipeline section 10, drive means 45, which was rollingly supported by pipeline section 10 on the top thereof, was operated upon command by an operator. The drive means was connected to enclosure 41, and the enclosure was longitudinally advanced to allow another pipeline section to be cleaned.

EXAMPLE 2

Application of Paint

Figure 10:
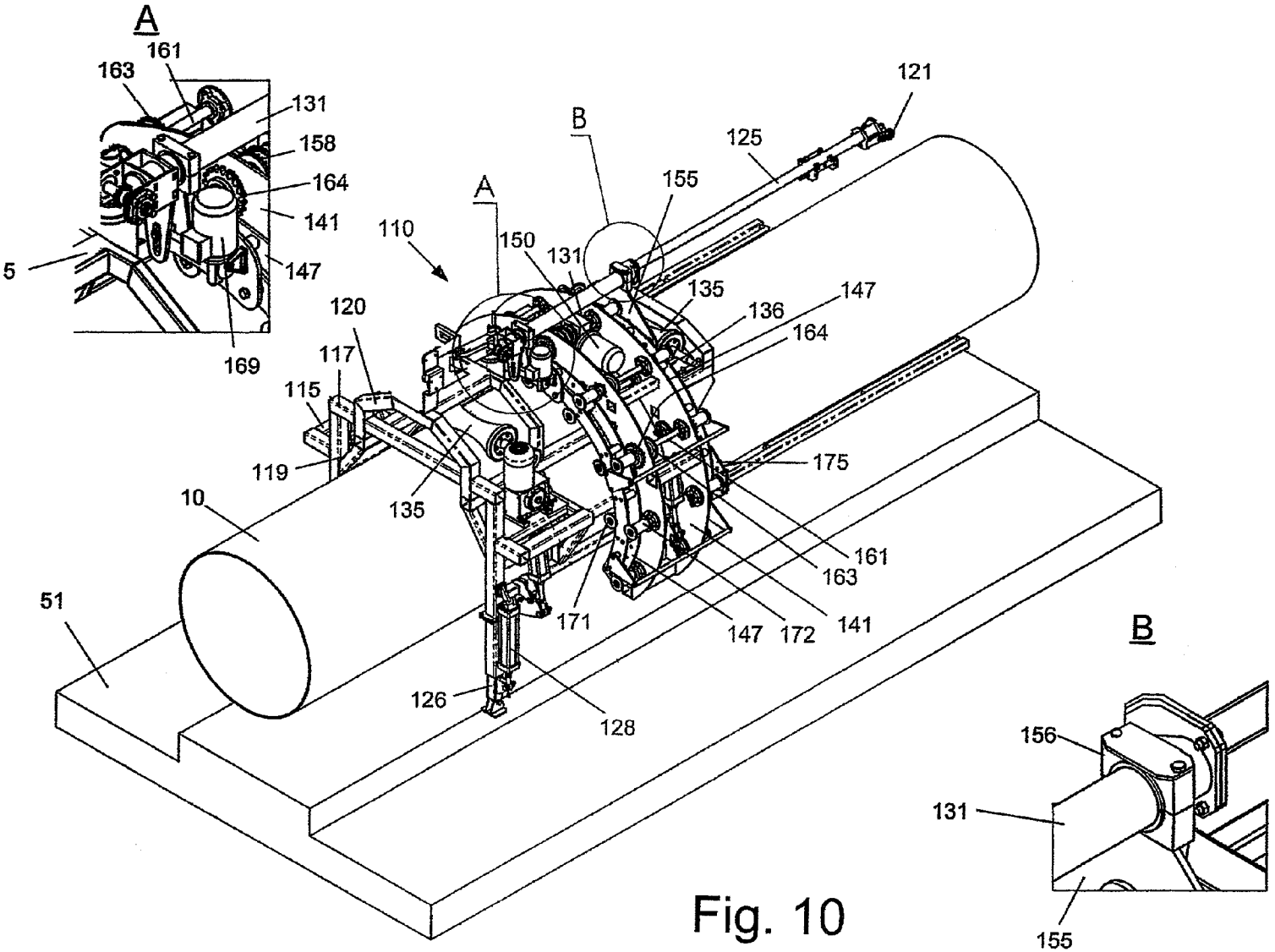
FIG. 10 is a perspective view of apparatus used for application of paint, in accordance with the present invection, showing magnified portions thereof in details A and B.

FIG. 10 illustrates an apparatus generally designated by numeral 110 that was used to apply a uniform coating of paint onto the outer surface of a buried pipeline having an inner diameter of 107 cm, when oil was flowing therethrough.

A trench 51 having a width of 3 m was dug, and a pipeline section 10 was raised a height of 50 cm. The pipeline section was supported by two supports spaced 30 m from each other.

Epoxy paint was entrained by compressed air, such that paint was delivered through tubular conduit 125 to nozzle 121 fixed at the distal end of the conduit. Conduit 125 was rotatably mounted within sheathing 131 in such a way that nozzle 121 was always directed to the periphery of pipeline section 10. Sheathing 131 in turn was rotated about the axis of pipeline section 10 a total angular displacement of 280 degrees, whereby nozzle 121, at the completion of an angular displacement, obliquely sprayed paint at the underside of the pipeline section.

Apparatus 110 was adapted to be longitudinally displaceable. Apparatus 110 was structured by a frame that comprised a plurality of interconnected longitudinally extending bars 115, laterally extending bars 117, vertically extending bars 119 and inclined bars 120. These bars were arranged such that the frame was symmetrical with respect to the axis of the pipeline section. Two concave rollers 135 having a variable cross-section were used to longitudinally displace the apparatus, wherein one of the rollers was an idler roller. The cross-section of rollers 135 varied in such a way that the resulting curvature was substantially equal to that of pipeline section 10, so that the rollers were placed on top of the pipeline section, with the axis of each roller being perpendicular to the axis of the pipeline section. The axles 136 of each roller 135 were rotatingly mounted in a corresponding ring hanger 137 affixed to a longitudinally extending bar 115, except for one axle of the driven roller which was driven by motor 138. Motor 138 was mounted on the frame of the apparatus, and when operated, the driven and idler rollers rotated, frictionally contacting the periphery of the pipeline section and thereby allowing apparatus 110 to be longitudinally displaced.

After being displaced to a desired pipeline section, the frame was immobilized by legs 126 that were anchored to trench 51. Each leg 126 was normally retained in a normally retracted disposition within a corresponding hollow longitudinally extending bar 119. Upon actuation of each hydraulic cylinder 128 that was mounted on a corresponding longitudinally extending bar 115, each corresponding leg 126 was downwardly displaced to trench 51 by means of the corresponding cylinder 128, and the frame was thereby immobilized.

Sheathing 131 was rotated about the axis of pipeline section by means of a pair of arcuate stabilizer members 141 and two pairs of arcuate rotatable members 147, with the pair of stabilizer members interposed between each pair of rotatable members. Stabilizer members 141 and rotatable members 147 were concentric with the axis of pipeline section 10, while the width of a rotatable member 147 was less than that of a stabilizer member 141. Guide rollers 171 and 172, which were rotatably mounted on stabilizer members 141, supported and radially restrained rotatable members 147. Since stabilizer members 141 were rigidly connected to the frame of the apparatus, members 147 were rotated relative to the stabilizer members when a torque was applied to the rotatable members, following immobilization of the frame.

Torque was transmitted to rotatable members 147 by a chain drive. To allow for a high rate of torque transmission and a compact balanced construction during rotation, each inner rotatable member 147 was made from two arcuate plates, between which a toothed transmission device was mounted. Four rods 161 connecting the two stabilizer members 141 were rotatably mounted therebetween, with the circumferential location of two rods being symmetrical about a vertical centerline of the pipeline section to that of the other two rods. A sprocket 163 was mounted on each rod 161 between the two stabilizer members 141, and an endless roller chain (not shown) was wrapped about each sprocket 163 and about sprocket 158 mounted on the output shaft of the motor 150. Another sprocket 164 was mounted on each rod 161, on the outer side of each stabilizer member 141. Each sprocket 164 was engageable with the transmission device that was mounted between the two plates of the inner rotatable member. As motor 150 was operated, sprocket 158 mounted on the output shaft of the motor was rotated, driving sprocket 164 mounted on the outer side of each stabilizer member 141 by means of the roller chain, and thereby causing rotatable members 147 to rotate. The angular displacement of the rotatable members was limited by abutment plates 175 that were affixed at the two circumferential ends, respectively, of a rotatable member. An abutment plate 175 was wider than a rotatable member 147, and therefore contacted a longitudinally extending rod 115 when the rotatable members were rotated beyond their rotational limit, thereby preventing additional rotation. Rotatable members 147 did not rotate in a reverse direction when motor 150 was deactivated due to the engagement of sprockets 164 with the transmission device integral with the rotatable members.

Sheathing 131 was connected to each pair of rotatable members 147 by triangular brace 155, at the circumferential middle of the rotatable members. The short end of each brace 155 was integrally formed with a ring support 156, into which sheathing 131 was inserted. As a result, sheathing 131 and rotatable members 147 rotated in unison. Motor 169 which caused conduit 125 to rotate was carried by the outer rotatable member, and therefore conduit 125 could rotate about the axis of sheathing 131 concurrently with the rotation of rotatable members 147 about the axis of pipeline section 10.

A controller (not shown) synchronized the operation of motors 150 and 169 so that nozzle 121 was always directed to the periphery of pipeline section 10, regardless of the angular position of sheathing 131. The controller also controlled the operation of a hydraulic actuator (not shown) which caused conduit 125 to retract into sheathing 131 at a fixed rate upon cessation of the rotation of rotatable members 147, whereby nozzle 121 generated an elongated impingement path which provided a uniform paint coating onto the periphery of the pipeline section. At the completion of the impingement path, conduit 125 telescoped to its maximum length and rotatable members 147 rotated to another angular position, such that the paint coating of the newly generated impingement path was continuous with, and having the same thickness as, the previously generated impingement path.

Motor 150 transmitted torque to rotating members 147. Nozzle 121, which was directed at the periphery of pipeline section 10, generated an elongated path of impingement, and paint was applied onto the periphery in such a way that a uniform thickness of paint was applied.

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

The invention claimed is:

1. An apparatus for spraying maintenance enhancing material onto the periphery of a tubular member positioned above a ground surface, comprising:

a) an apparatus frame which is longitudinally displaceable with respect to the tubular member;

b) at least one stabilizer member rigidly connected to said frame;

c) at least one rotatable member supported and radially restrained by a plurality of guide rollers rotatably mounted on the at least one stabilizer member, wherein each of the at least one rotatable member, upon application of a torque thereto, is rotatable relative to the corresponding stabilizer member, following immobilization of said frame;

d) at least one nozzle which is displaceable along and/or around the tubular member for generating a spray of maintenance enhancing material onto the periphery of the tubular member, each of the at least one nozzle being carried by a corresponding conduit rotatably mounted within a sheathing which is connected to the at least one rotatable member in such a way that i. the at least one nozzle continuously faces the periphery of the tubular member;

ii. the periphery of said tubular member is completely impinged by the spray issuing from each nozzle; and iii. a line corresponding to the shortest distance of a spray issuing from the at least one nozzle to the periphery of said tubular member is oblique with the radius of said tubular member or is collinear with the radius of said tubular member upon displacement of the at least one nozzle longitudinally along or rotatable about a circumferential distance less than the circumference of, the tubular member; and e) means for delivering maintenance enhancing material to said at least one displaceable nozzle, wherein torque is transmitted to each of the at least one rotatable member by a plurality of driven sprockets mounted on the outer side of each of the at least one stabilizer member, said plurality of driven sprockets being engageable with a toothed transmission device mounted between two plates from which a rotable member is formed.

2. The apparatus according to claim 1, wherein the at least one nozzle for spraying the lowest point of a horizontally disposed tubular member is positioned such that the angle between the line corresponding to the shortest distance of a spray issuing from said at least one nozzle to the periphery of the tubular member and the vertical centerline of the tubular member is greater than 20 degrees.

3. The apparatus according to claim 1, wherein the spray generating means are a plurality of displaceable nozzles, the sprayed material being entrained by a fluid under sufficient pressure to allow a spray of said material to impinge the periphery of the tubular member.

4. The apparatus according to claim 1, wherein the spray generating means are a plurality of driven rollers, to each of which sprayed material is delivered, said solution being dispersed in form of a spray by means of the rotation of each driven roller.

5. The apparatus according to claim 4, wherein the circumferential distance of impingement along the periphery of the tubular member is controllable.

6. The apparatus according to claim 1, wherein the at least one nozzle is rotatable about an axis substantially perpendicular to the axis of the tubular member, an elongated path of impingement being generated along the periphery of the tubular member.

7. The apparatus according to claim 6, wherein the conduit is retractable within the corresponding sheathing upon cessation of the rotation of each of the at least one rotatable member, whereby to generate a first elongated impingement path.

8. The apparatus according to claim 7, wherein each of the at least one rotatable member are rotatable by means of a motor about the axis of the tubular member from a first to a second angular position and the conduit is expandable to its maximum length upon completion of the first elongated impingement path.

9. The apparatus according to claim 1, wherein each of the at least one rotatable member and each of the at least one stabilizer member are arcuate.

10. The apparatus according to claim 9, wherein the angular displacement of the rotatable members is limited by abutment plates for contacting the apparatus frame when each of the least one rotatable member is rotated beyond a predetermined rotational limit, said abutment plates being affixed at the two circumferential ends, respectively, of a rotatable member.

11. The apparatus according to claim 1, wherein the engagement of said driven sprockets with said toothed transmission device prevents the reverse rotation of each of the at least one the rotatable member upon cessation of the torque.

12. The apparatus according to claim 1, wherein the apparatus is longitudinally displaceable by means of at least one concave roller having a variable cross-section with a sufficiently equal curvature to that of the tubular member, so that a roller placed on top of the tubular member is in frictional engagement with the periphery thereof, each of said concave rollers being rotatingly mounted in a corresponding hanger affixed to the frame of the apparatus, rotation of one of said concave rollers thereby inducing longitudinal displacement of the apparatus.

13. The apparatus according to claim 12, wherein the apparatus further comprises an enclosure placed around the tubular member, which allows for the collection of and recycling of spent granular abrasive material.

14. The apparatus according to claim 1, wherein the maintenance enhancing material is selected from the group of paint, granular abrasive material and high-pressure fluid.

15. The apparatus according to claim 14, wherein the granular abrasive material is sand, metallic granules or polymeric granules.

16. The apparatus according to claim 1, wherein the apparatus further comprises an enclosure placed around the tubular member, which allows for the collection of and recycling of spent granular abrasive material.

17. The apparatus according to claim 16, wherein the enclosure is longitudinally displaceable by means of the at least one concave roller having a variable cross-section.

18. The apparatus according to claim 16, further comprising vacuum generating means for drawing spent granular abrasive material and debris detached from the tubular member to at least one filter, and a particulate separator for separating purified abrasive granules from other debris, recycled granular abrasive material thereby being collected into a suitable vessel.

19. The apparatus according to claim 18, wherein the recycled granular abrasive material is entrainable by a fluid which is deliverable to the spray generating means.

20. The apparatus according to claim 19, wherein the vacuum generating means, the at least one filter and means for generating the fluid for entraining the recycled granular abrasive material are stationary.

21. The apparatus according to claim 1, wherein the apparatus is suitable for the removal of corrosion.

22. The apparatus according to claim 1, wherein the apparatus is suitable for the application of paint.

23. The apparatus according to claim 1, wherein the spray generating means comprise a casing and an impeller rotatable within said casing, said casing formed with a plurality of closed portions and open portions, the maintenance enhancing material being admitted to the interior of said casing and radially exiting said casing through said open portions.

24. The apparatus according to claim 23, wherein each of said closed portions longitudinally extends throughout the entire length of said casing.

25. The apparatus according to claim 1, wherein the sheathing is connected to a pair of rotatable members by means of a triangular brace, a short end of said brace being integrally formed with a ring support into which the sheathing is inserted.

* * * * *

UNITED STATES PATENT AND TRADEMARK OFFICE

CERTIFICATE OF CORRECTION

PATENT NO. : 7,442,256 B2
APPLICATION NO. : 10/996656
DATED : October 28, 2008
INVENTOR(S) : Sela et al.

It is certified that error appears in the above-identified patent and that said Letters Patent is hereby corrected as shown below:

Title page, insert the following:
--(30) Foreign Application Priority Data
Nov. 27, 2003 (IL) ..... 159104--.

Column 4,
Line 49, "invection" should read --invention--.

Signed and Sealed this

Twenty-seventh Day of January, 2009

JOHN DOLL
*Acting Director of the United States Patent and Trademark Office*